US005421485A

United States Patent [19]

Furuta et al.

[11] Patent Number: 5,421,485

[45] Date of Patent: Jun. 6, 1995

[54] LIQUID DISPENSING UTENSIL AND BAGS FOR USE WITH THE UTENSIL

[75] Inventors: Katsuji Furuta; Yukihiko Shibata, both of Nagoya; Katsuya Morii, Yagoya, all of Japan

[73] Assignee: Daiwa Gravure Co., Ltd., Nagoya, Japan

[21] Appl. No.: 147,660

[22] Filed: Nov. 2, 1993

[30] Foreign Application Priority Data

Dec. 1, 1992 [JP] Japan ..... 4-321070
Feb. 26, 1993 [JP] Japan ..... 5-037659

[51] Int. Cl.[6] ..... B65D 35/28

[52] U.S. Cl. ..... 222/95; 222/105; 383/104; 383/202

[58] Field of Search ..... 383/89, 104, 113, 116, 383/120, 122, 124, 200, 202, 208, 906; 222/95, 105, 383

[56] References Cited

U.S. PATENT DOCUMENTS

| | | | |
|---|---|---|---|
| 3,854,653 | 12/1974 | Engelsberger | 383/210 |
| 3,935,993 | 2/1976 | Doyen et al. | 383/104 X |
| 3,938,706 | 2/1976 | Cohen | 222/95 X |
| 4,265,372 | 5/1981 | Wainberg | 222/94 X |
| 4,265,949 | 5/1981 | Kugimiya | 383/113 X |
| 4,440,317 | 4/1984 | Clark et al. | 222/105 X |
| 4,454,979 | 6/1984 | Ikeda et al. | 383/104 X |
| 4,686,814 | 8/1987 | Yanase | 383/89 X |
| 4,704,731 | 11/1987 | Katase et al. | 383/120 |
| 5,031,798 | 7/1991 | Wild | 222/105 X |
| 5,056,685 | 10/1991 | Wild | 222/105 X |

FOREIGN PATENT DOCUMENTS

| | | | |
|---|---|---|---|
| 4203798 | 8/1993 | Germany | 383/104 |
| 9114630 | 10/1991 | WIPO | 222/95 |

*Primary Examiner*—Allan N. Shoap
*Assistant Examiner*—Jes F. Pascua
*Attorney, Agent, or Firm*—C. J. Fildes & Co.

[57] ABSTRACT

A utensil for dispensing liquid, such as detergent, from a bag set in the utensil which contains the liquid, and bags for use with the utensil. The bag is comprised of a synthetic resin film and is housed in a container body having an opening at its top end. The top end opening of the container body is closed by a cover member to which is attached a liquid delivery element, such as a pump with a nozzle. A suction tube projects downward from the liquid delivery element. The tube is adapted to sealingly pierce the upper surface of the bag set in the container body for communication with the interior of the bag. That portion of the bag which is pierced by the suction tube is formed of a nylon film, or an unstretched nylon film in particular. Therefore, the tube is not liable to be torn when pierced by the tube, and a hole formed by the piercing comes in close contact with the tube.

6 Claims, 8 Drawing Sheets

LIQUID DISPENSING UTENSIL AND BAGS FOR USE WITH THE UTENSIL

FIELD OF THE INVENTION

This invention relates to a liquid dispensing utensil for delivery of liquid, such as detergent, from a bag set in the utensil which contains the liquid, and bags for use with the utensil.

BACKGROUND OF THE INVENTION

Hitherto, liquids such as detergents for household use or the like have been sold in a package form such that the liquid is packed in a resin-made or paper-made container. When the detergent in the container has run out, the user may purchase a refill for the detergent container which is packed in, for example, a resin-made bag, so that the empty container is refilled with the refill detergent.

For the purpose of refilling the empty container with such a liquid refill, it is usual practice that the user holds the refill or a liquid-containing resin-made flexible bag in hand so as to allow the liquid to be poured into the container. However, the problem is that the bag is so soft that the mouth portion of the bag is positionally unstable so that it is troublesome to refill the container with the refill liquid while holding the bag in mouth-to-mouth contact relation with the container. Furthermore, unless sufficient care is used, it is likely that there will occur some liquid spill off the container.

DISCLOSURE OF THE INVENTION

This invention is intended to solve such a problem with the prior art and, accordingly, it is an object of the invention to eliminate the need for a liquid refilling operation and to enable a bag containing a liquid refill, such as a detergent refill, to be used as it is.

In order to accomplish this object, according to the invention there is provided a utensil for dispensing liquid contained in a container which comprises:

- a bag made of a synthetic resin film and filled with a liquid material, such as a detergent,
- a container body having an opening at the top end thereof and adapted to receive the bag therein,
- a cover member for closing the top end opening of the container body,
- a liquid delivery element, such as a pump with a nozzle, attached to the cover member, and
- a suction tube projecting downward from the liquid delivery element and adapted to sealingly pierce through the top of the bag housed in the container body for communication with the interior of the bag.

According to such arrangement, by setting a bag filled with detergent or the like liquid in the container body the need for a liquid refilling operation is eliminated, and it is possible to use the liquid-filled bag as it is so that the liquid in the bag may be dispensed as required via the liquid delivery element or the pump with a nozzle.

The bag according to the invention has a portion through which the suction tube penetrates into the bag and which is formed of a nylon film or unstretched nylon film.

Therefore, the bag is not liable to be torn when the tube penetrates therethrough, and a hole created by the tube penetration comes into close contact with the tube, so that air is unlikely to enter the bag. When the liquid in the bag has been decreased to a small quantity, the remaining liquid in the bag can be taken out nearly to a last drop. Further, even when the container falls down, there is no likelihood of liquid leak out of the container.

The bag has four planes and is sealed at its longitudinally spaced opposite ends. When inserting the bag into the container, it is advantageous to bend the bag at the longitudinally spaced ends in such a manner that the ends overlap each other along the central outer surface of the bag, to enable the liquid within the bag to be drawn closer to the center of the bag.

Constructed as above described, the bag is held in an externally stretched condition to permit easier penetration of the suction tube into the bag.

DESCRIPTION OF THE PREFERRED EMBODIMENTS

Figure 1:
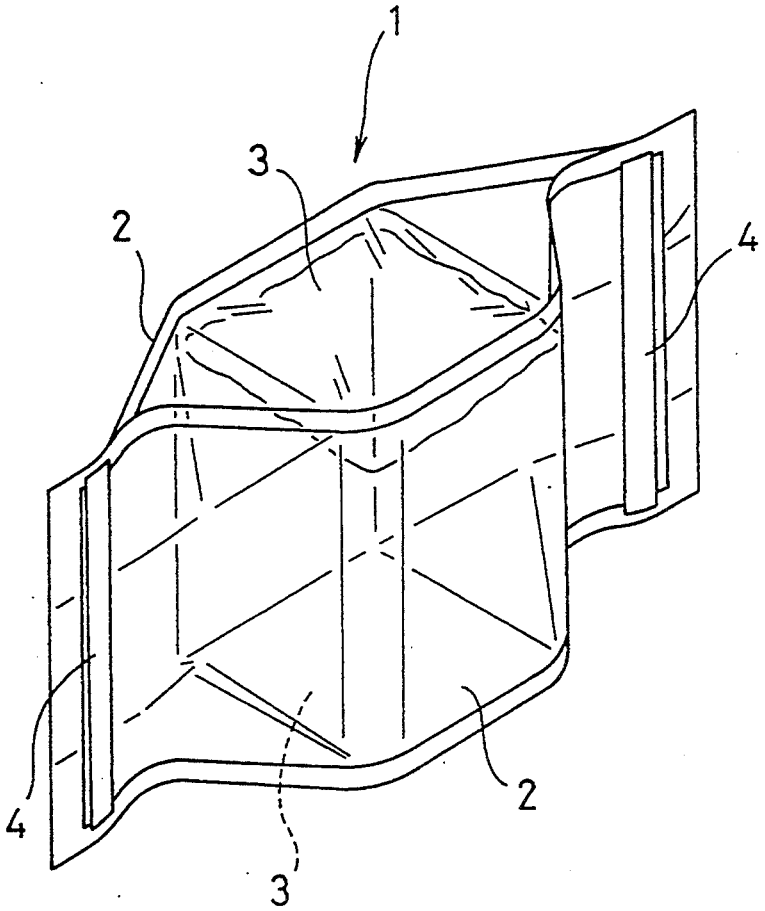
FIG. 1 is a perspective view of a bag in one embodiment of the invention.

One embodiment of the invention will now be described with reference to FIGS. 1 to 4.

In FIGS. 1 through 4, the reference numeral 1 designates a synthetic resin bag which contains liquid, such as detergent. The bag 1 is a so-called gadget bag. In particular, the bag comprises larger and smaller sheets 2 and 3 of two each which are identical in length but different in width. These pairs of sheets 2, 2; 3, 3 are longitudinally arranged and then sides of the larger sheets 2, 2 are connected by the smaller sheets 3, 3 by heat sealing so that a tubular body is formed. The smaller sheets 3, 3 are folded inwardly at a widthwise median point thereof, whereby the tubular body is rendered flat. The flat tubular body is then closed by heat sealing at one of its longitudinally spaced ends, and then liquid, such as detergent, is filled into the interior of the tubular body. Subsequently, the other end of the flat tubular body is closed flat by heat sealing to thereby form the tubular body into a structure having four planes.

To construct the bag 1, a laminated film comprising, for example, a stretched nylon film and a polyolefin film laminated together is used for three sheets 2, 2, 3 other than one smaller sheet 3. For the one smaller sheet 3 is used, for example, a laminated film comprising an unstretched nylon film and a polyolefin film laminated together.

The bag 1 constructed as above described in which is filled liquid, such as detergent, is fitted with double coated adhesive tapes 4, 4 on outer surface portions of one of the larger sheets 2 adjacent longitudinally spaced opposite ends of the bag 1.

Numeral 5 designates a synthetic resin-made container body. The container body 5 is open at its top end and can receive through this opening 6 a bag 1 filled with liquid, such as detergent, in such a condition that the one smaller sheet B is positioned upside. With the bag 1 received in position, the top end opening 6 is closed by a synthetic resin-made cover member 7. The cover member 7 is fitted with a liquid delivery pump 8 from which a suction tube 9 projects downward.

The suction tube 9 is rigidly constructed of a medium-density polyethylene or polypropylene, and its tip is obliquely cut sharp so as for it to pierce the one smaller sheet 3, being positioned within the bag 1 at a location adjacent the lower end of the bag 1. In this case, because of the fact that the one smaller sheet 3 is made of an unstretched nylon film, the sheet 3 is not liable to be torn when the lower end of the suction tube 9 penetrates through the sheet 3, and a hole formed through this penetration comes in close contact with the suction tube 9.

Numeral 10 designates a nozzle provided on the pump which serves to deliver the liquid sucked into the suction tube 9.

Figure 2:
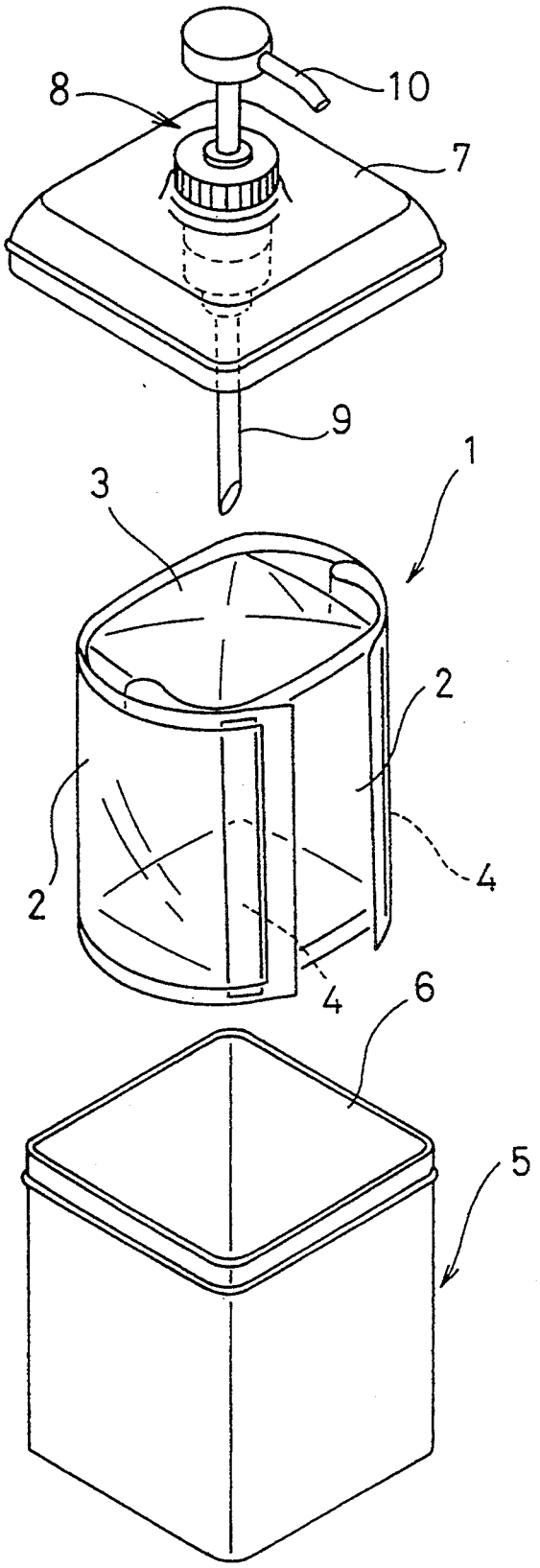
FIG. 2 is an exploded perspective view of a liquid dispensing utensil in its overall configuration according to the FIG. 1 embodiment.

Nextly, the manner in which the above described liquid dispensing utensil is to be used will be explained. For example, a household user first places a bag 1 filled with liquid, such as detergent, in the container body 5 so that the one smaller sheet 3 is positioned on the top end side of container body 5. In this case, the longitudinally spaced opposite ends of the bag 1 are bent so as to overlap with the one larger sheet 2 as shown in FIG. 2 so that the liquid within the bag 1 is drawn toward the center of the bag 1. The both ends as so bent are held on the outer surface of the sheet 2 under the adhesive force of the double-coated adhesive tapes 4, 4.

As a consequence, the smaller sheet 3 at the top end of the bag 1 is stretched under the internal pressure of the bag 1, and this allows the suction tube 9 of the pump 8 to easily pierce the smaller sheet 3 when the cover member 7 is attached to the top end of the container body 5. When the cover member 7 has been attached to the top end of the container body 5, the head of the pump 8 is pushed downward and then returned upward, whereby the liquid in the bag 1 is drawn up via the suction tube 9. Repeating this process of operation several times results in intermittent delivery of liquid through the nozzle 10.

The bag 1 may be entirely made of a laminated film comprising an unstretched nylon film and a polyolefin film laminated together. Alternatively, it may be of such a construction that a part of the bag 1 is formed from a laminated film comprising an unstretched nylon film and a polyolefin film laminated together while the other larger part of the bag is formed from a laminated film comprising a stretched nylon film and a polyolefin film laminated together.

In the embodiment shown in FIGS. 1 through 4, the bag 1 is placed in the container body 5 so that the one smaller sheet 3 is positioned on the upper end side for being pierced by the suction tube 9. However, depending upon the configuration or the like of the container body 5, the bag 1 may be placed in the container body 5 in such a way that a median outer surface portion of one larger sheet 2 faces upward so that the larger sheet 2 is pierced by the suction tube 9. In this case, a laminated film comprising an unstretched nylon film and a polyolefin film laminated together is preferably used for the larger sheet 2.

Figure 3:
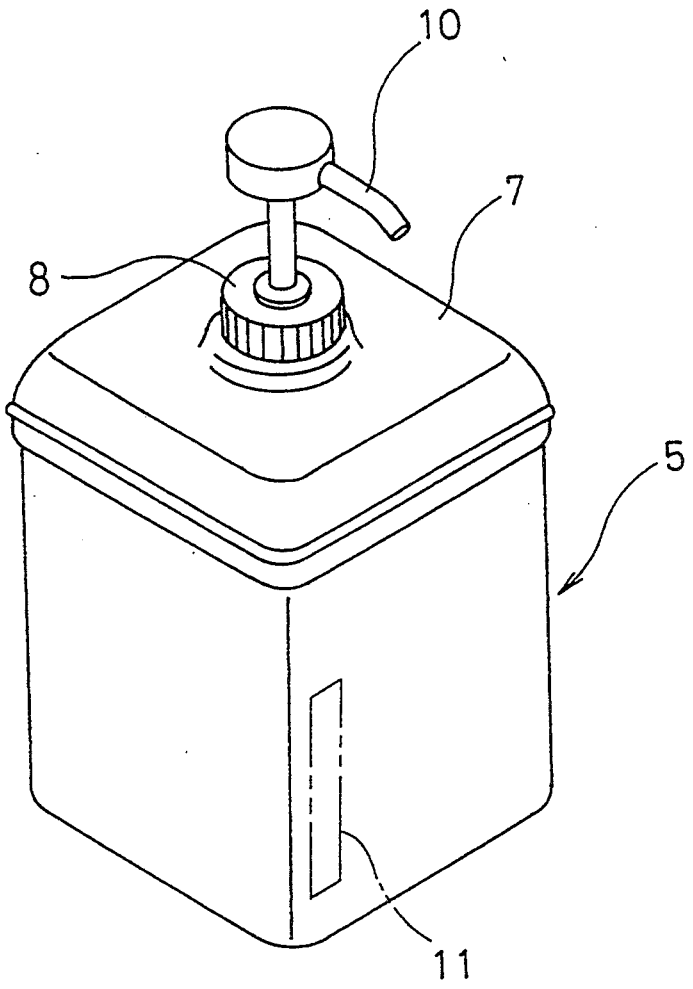
FIG. 3 is a perspective view showing a container body of the utensil in which the bag is set in position, with a cover member attached to the container body.
Figure 4:
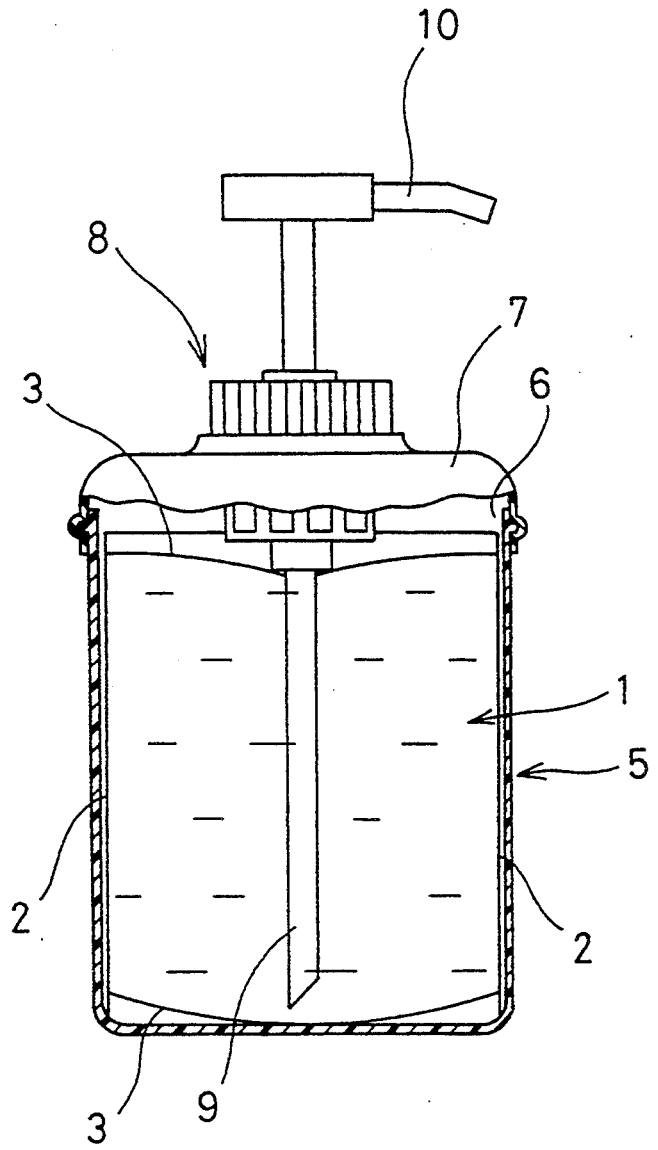
FIG. 4 is a sectional view of the utensil shown in FIG. 3.
Figure 5:
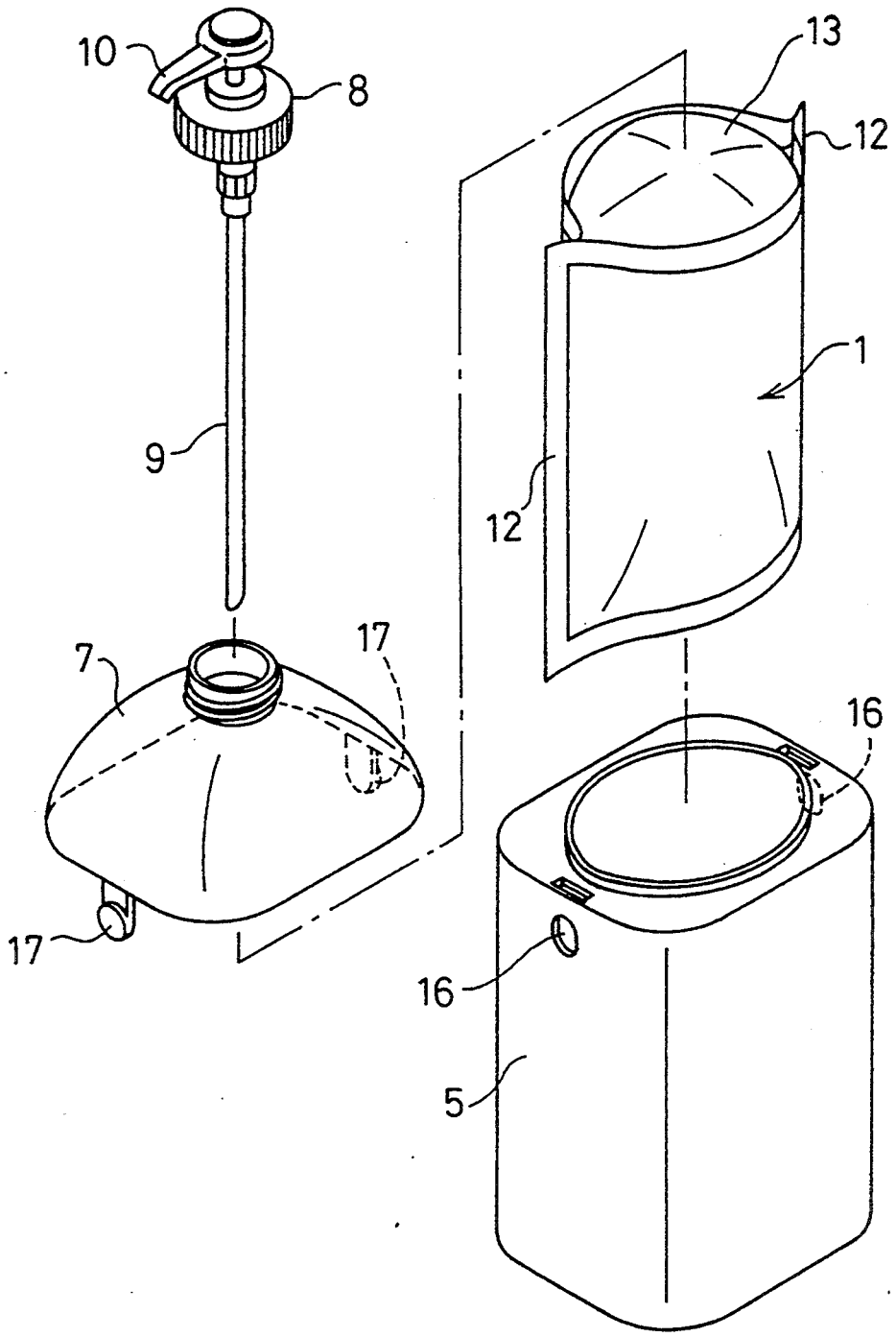
FIG. 5 is an exploded perspective view of a utensil according to another embodiment of the invention, with a liquid-containing bag, a container body, and a cover member being shown separately.

The container body 5 may be transparent or opaque. Where it is transparent, it is possible to determine the quantity of liquid present in the bag 1 from outside of the container body 5. Also, by forming a vertical window 11 adjacent the lower end of the container body 5 as shown by double dashed chain lines in FIG. 3 is it possible to check the quantity of liquid present in the bag 1.

The liquid to be filled in the container body 5 for delivery therefrom is not limited to detergent, and may be any other kind of liquid, e.g., oil, liquid seasoning, such as soy sauce, milk or juice.

FIGS. 5 through 9 illustrate another embodiment of the invention.

In FIGS. 5 to 9, a bag 1 is of a stand pack (self supporting) configuration and has sealed portions 12, 12 formed by heat sealing along at least two opposite sides of the bag, with a bulged bottom 13 formed at its lower end on which the bag may be supported with the sides upstanding. In these figures, the bag 1 is shown upside down so that the bottom 13 is positioned on the top side.

Figure 6:
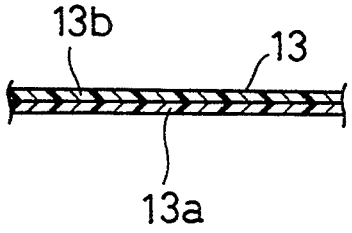
FIG. 6 is an enlarged sectional view of a bottom portion of the liquid-containing bag shown in FIG. 5.
Figure 7:
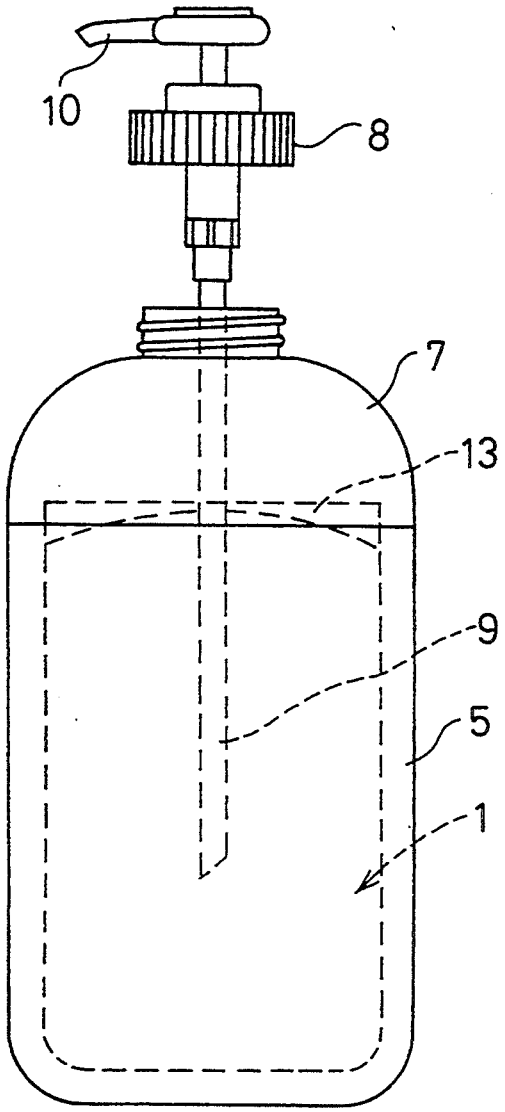
FIG. 7 is a front view showing the container body in FIG. 5 in which the liquid-containing bag is set in position, with the cover member attached to the upper end of the container body.
Figure 8:
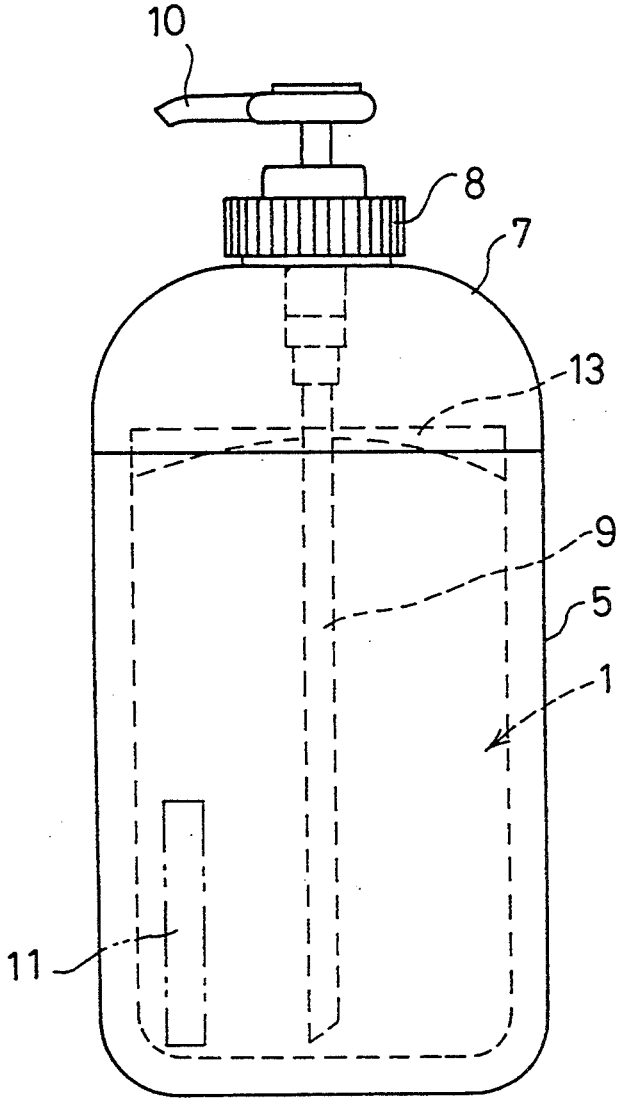
FIG. 8 is a front view showing the cover member in FIG. 7 with a pump with a nozzle as attached to the cover member.
Figure 9:
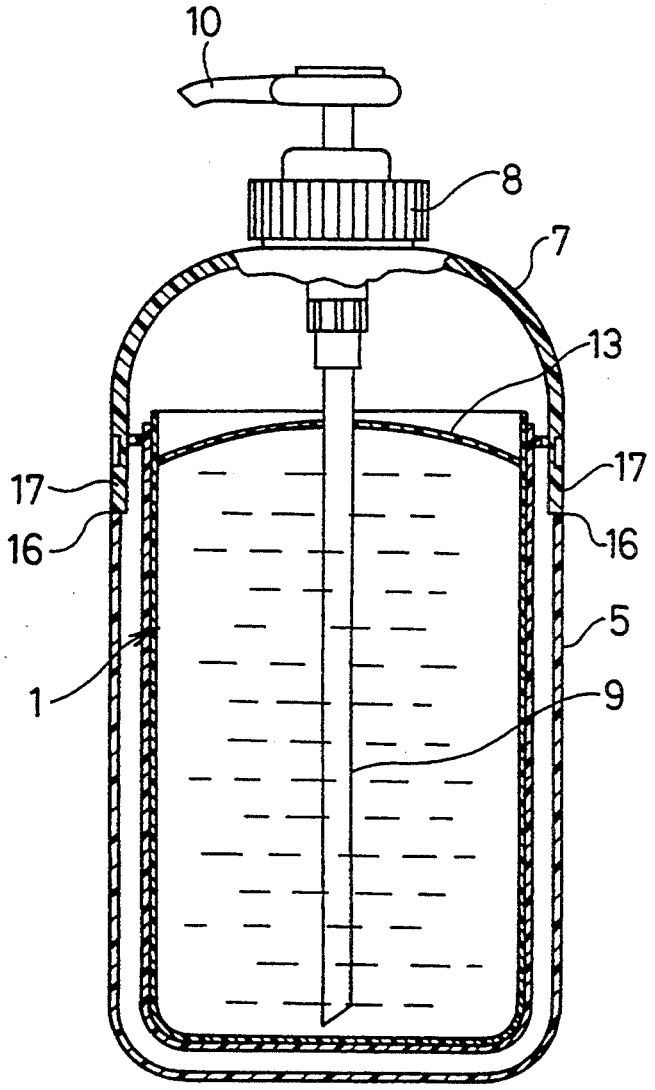
FIG. 9 is a sectional view of the utensil shown in FIG. 8.

Portions of the bag 1 other than the bottom 13 are formed from a laminated film comprising a stretched nylon film and a polyolefin film laminated together as in the embodiment shown in FIGS. 1 to 4. The bottom 13, as shown in FIG. 6, is formed from a laminated film comprising an unstretched nylon film 13*a* and a polyolefin film 13*b* laminated together, as in the embodiment shown in FIGS. 1 to 4. Polyolefin films for forming a laminated structure, positioned on the inner side, are fusion bonded by heat sealing to form a bag 1 of the stand pack type.

The container body 5 in this embodiment is of an open topped vertically longer construction such that the bag 1 can be placed therein upside down so that the bottom 13 is positioned on the top side as stated above. The container body 5 is formed at opposite locations adjacent the upper end thereof with apertures 16, 16 which are engaged by pawl pieces 17, 17 depending from a cover member 7, from corresponding interior locations adjacent the upper end of the container body 5 so that the container body 5 and the cover member 7 can be joined together.

In this embodiment as well, because of the fact that the bottom 13 is constructed of an unstretched nylon film 13*a*, the bottom 13 of the bag 1 is not liable to be torn when the bottom 13 is pierced by the tube 9, and a hole created by this piercing comes into close contact with the tube 9.

In this embodiment, too, when the bag 1 is placed in the container body 5 in an upside-down condition, the liquid within the bag 1 is drawn toward the center of the bag 1 so that the bottom 13 positioned on the upper end side is kept in a flatly stretched condition. More particularly, the bag 1 is folded at its lower end and opposite side portions and this exerts a squeezing force to the bag 1. The internal size of the container body 5 is predetermined so that such a condition can be maintained when the bag 1 is placed in the container body 5.

Nextly, the manner in which the above described liquid dispensing utensil is used will be explained. The user will set the bag 1 upside down in the container body 5. For this purpose, the bag 1 is folded at its lower end and opposite sides to apply a squeeze to the bag 1, and the bag 1 is set in the container body 5 in that condition so that the liquid in the bag 1 is drawn toward the center of the bag 1 in the upside-down condition thereof to enable the top-side positioned bottom 13 to become flatly stretched. Since the bottom 13 becomes flatly stretched in this way, the bottom 13 of the bag 1 can be easily pierced by the tube 9 of the pump 8 when the cover body 7 is attached to the upper end of the container body 5.

As earlier stated, the bottom 13 of the bag 1 is formed from an unstretched nylyon film 13*a* and, therefore, the bottom 13 is not liable to be torn when it is pierced by the tube 9, and comes into close contact with the tube 9. Thus, air is unlikely to enter the bag 1 and, when the liquid in the bag 1 is decreased to a small quantity, the liquid can be taken out nearly to a last drop. When the container body should fall down, there is no possibility of liquid leak from the interior of the bag 1 into the container body 5.

Nextly, one experimental example will be explained. In order to determine the possibility of liquid leak from a pierced portion of the bag 1 when the bottom 13 of the bag 1 is pierced by the tube 9, pressure tests were conducted by applying a load of 80 kg upon sides of the bag 1 and according to "Food Additive Standards, Paragraph 3, Utensil and Container Packaging, B-2, Pressure Testing" provided for in the Japanese Food Sanitation Law. The tests witnessed that there was no liquid leak observed.

The configuration of the container body 5 or pump 8 is not limited to the one shown. A member having no pumping function and simply comprising a liquid delivery port and a tube may be employed.

In the foregoing embodiment, the bottom 13 of the bag 1 is constructed of a laminated film comprising two layers of an unstretched nylon film 13*a* and a polyolefin film 13*b*. In another form, however, the bottom 13 may be formed of a laminated film comprising an unstretched nylon film 13*a*, a polyolefin film 13*b*, and another film interposed between the two films. In a still another form, the bottom 13 may be formed from a laminated film comprising another film laminated on the outer side of an unstretched nylon film 13*a*.

What is claimed is:

1. A combination of a bag and a container adapted to receive the bag therein, said bag being made of a synthetic resin film and filled with a liquid material, said container comprising a liquid delivery element and a suction tube projecting from the liquid delivery element into the container and adapted to sealingly pierce through the bag for communication with the interior of the bag, and said synthetic resin film is a laminated film comprising a nylon film and other resin film laminated together, wherein the bag has four planes and is sealed at its longitudinally spaced opposite ends, and wherein, when the bag is inserted into the container, the bag is bent at the longitudinally spaced ends in such a manner that each end overlaps the central outer surface of the bag, to enable the liquid within the bag to be drawn closer to the center of the bag.

2. A combination as set forth in claim 1, wherein the bag has a double-coated adhesive tape attached to the longitudinally spaced opposite ends thereof, the adhesive tape holding the opposite ends of the bag in adhesion bond with a center portion of the bag.

3. A combination of a bag and a container adapted to receive the bag therein, said bag being made of a synthetic resin film and filled with a liquid material, said container comprising a liquid delivery element and a suction tube projecting from the liquid delivery element into the container and adapted to sealingly pierce through the bag for communication with the interior of the bag, and said synthetic resin film is a laminated film comprising a nylon film and other resin film laminated together, wherein the bag is of a self-supporting type having a bottom and sides including projecting sealed portions joining the sides, and wherein the bag is placed upside down in the container, with the bottom positioned upside, and the container is sized to fold the sealed portions against the bag when placed in the container to squeeze the liquid therein and flatten the bottom, so that the bottom is easily pierced by the suction tube.

4. A combination as set forth in either of claims 1 and 3, wherein the other resin film is a polyolefin film.

5. A combination as set forth in claim 4, wherein the nylon film forming at least a portion of the bag which is pierced by the suction tube is an unstretched nylon film.

6. A combination as set forth in claim 5, wherein the unstretched nylon film is positioned on the outer side of the bag and the polyolefin film is positioned on the inner side of the bag.

* * * * *